United States Patent [19]

Prough

[11] 4,220,498

[45] Sep. 2, 1980

[54] OXYGEN REACTOR SYSTEMS PULP REJECT TREATMENT

[75] Inventor: James R. Prough, Glens Falls, N.Y.

[73] Assignee: Kamyr, Inc., Glens Falls, N.Y.

[21] Appl. No.: 969,495

[22] Filed: Dec. 14, 1978

[51] Int. Cl.[2] ..... D21C 9/10

[52] U.S. Cl. ..... 162/25; 162/55; 162/60; 162/62; 162/65; 162/236; 162/252; 162/49

[58] Field of Search ..... 162/19, 25, 28, 55, 162/62, 60, 49, 65, 90, 261, 252, 236, DIG. 10

[56] References Cited

U.S. PATENT DOCUMENTS

| | | | |
|---|---|---|---|
| 3,830,688 | 8/1974 | Mannbro | 162/65 |
| 3,963,561 | 6/1976 | Richter | 162/65 |
| 4,000,063 | 12/1976 | Laasko | 209/233 |

FOREIGN PATENT DOCUMENTS

| | | | |
|---|---|---|---|
| 1002361 | 12/1976 | Canada | 162/DIG. 10 |
| 1026910 | 2/1978 | Canada | 162/25 |
| 2439654 | 3/1975 | Fed. Rep. of Germany | 162/28 |

OTHER PUBLICATIONS

Kleppe et al., Tappi vol. 59, No. 11, pp. 77–80, Nov. 1976.

MacLeod, Tappi vol. 60, No. 2, pp. 128–129, Feb. 1977.

*Primary Examiner*—William F. Smith

*Attorney, Agent, or Firm*—Cushman, Darby & Cushman

[57] ABSTRACT

A method and apparatus for the delignification of cellulosic fiber material to minimize the amount of reject material in the final pulp produced. The fiber material is digested, washed, oxygen delignified, and passed through a screening stage to provide a main pulp stream, and a reject stream from the separation stage. The flow and consistency of the separated reject material is determined, the reject material is refined, and sufficient chemical is added to the separated reject material, based upon the flow and consistency thereof, so that subsequent delignification of the reject material may be effected. This may be accomplished either by passing the reject material through a separate oxygen delignification stage and then returning it to the main pulp stream, or adding caustic to it and soaking it in a soak tank for predetermined period of time, and then returning it to the main pulp stream before the oxygen delignification stage therein.

15 Claims, 7 Drawing Figures

Fig. 1a — PRIOR ART
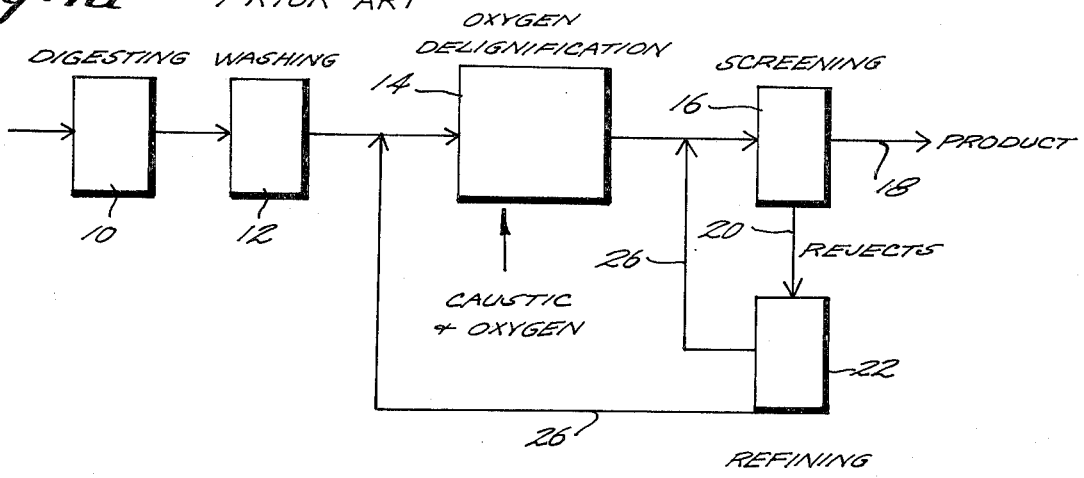
Fig. 1b — PRIOR ART
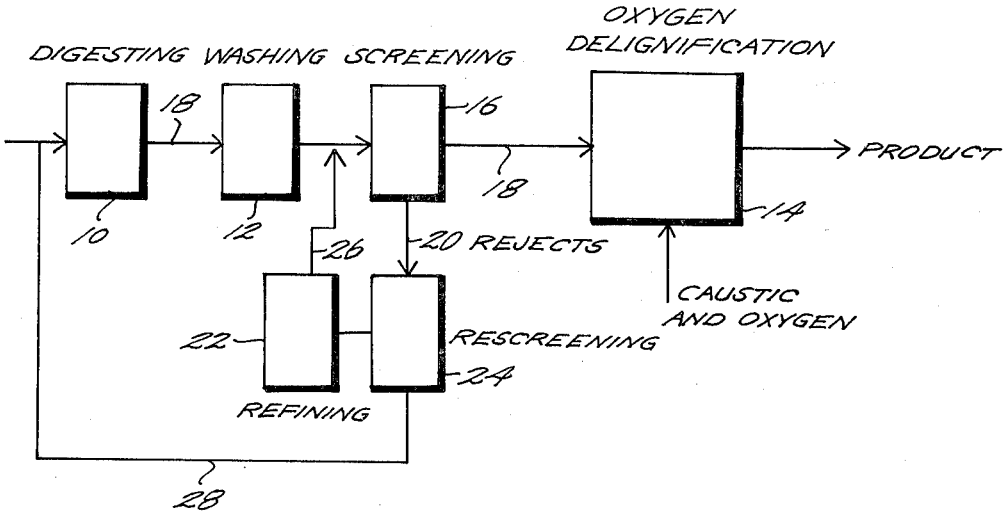
Fig. 1c — PRIOR ART
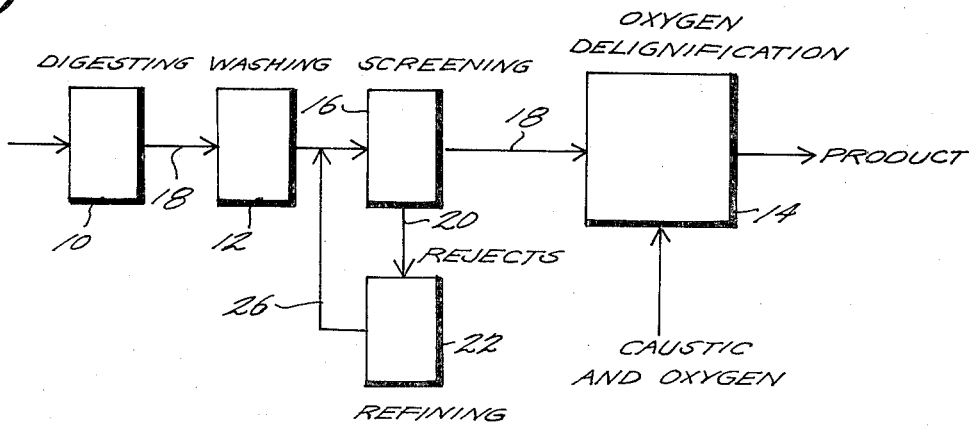

Fig. 2b
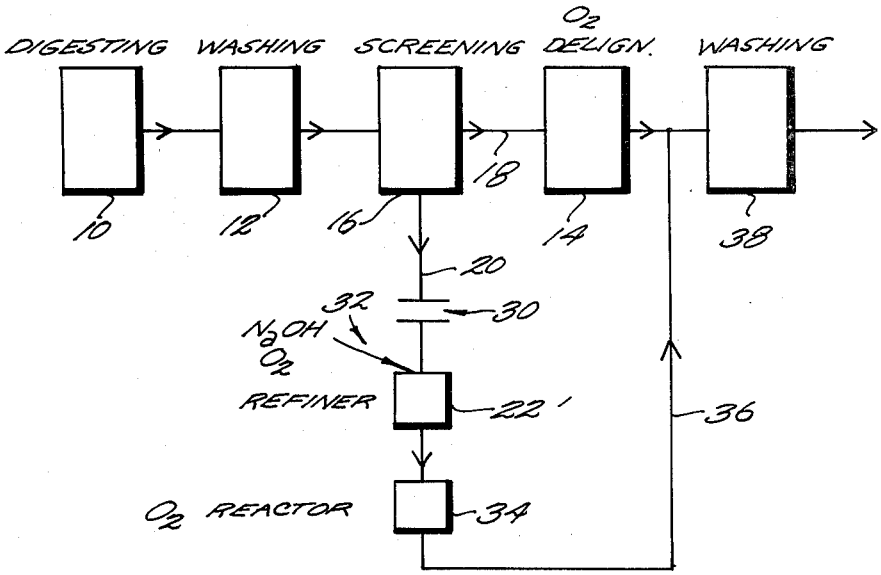
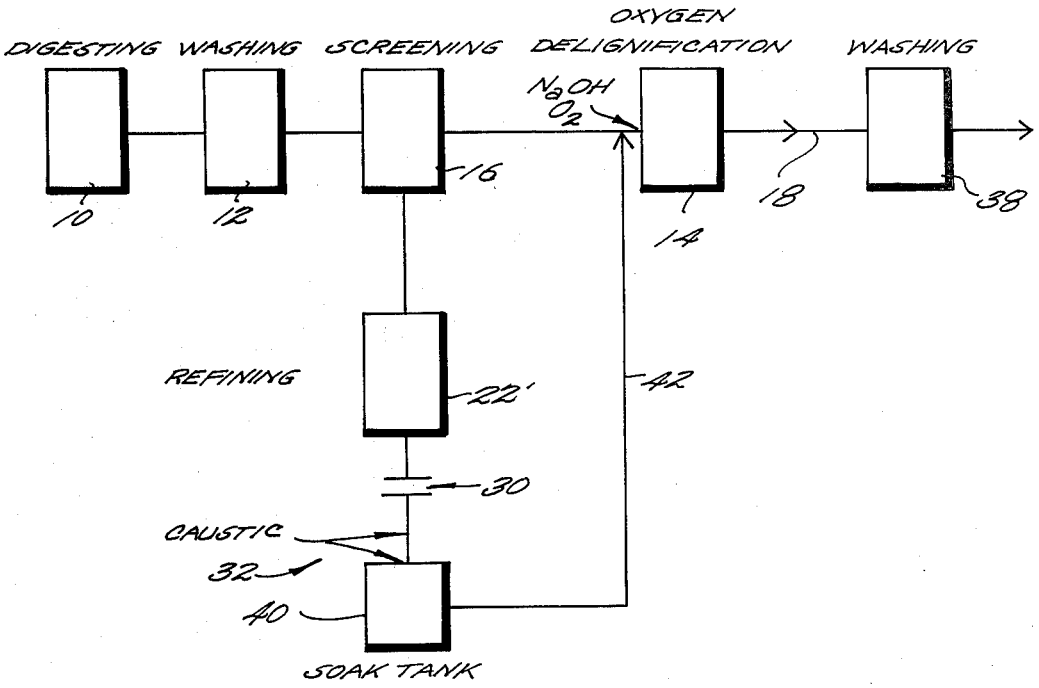
Fig. 3b

OXYGEN REACTOR SYSTEMS PULP REJECT TREATMENT

BACKGROUND AND SUMMARY OF THE INVENTION

During the treatment of cellulosic fiber material to produce pulp, portions of the pulp which have an extremely high concentration of lignin (e.g., knots) are not sufficiently treated, thereby producing reject material in the product stock and reducing the quality thereof. This is because the delignification processes are geared toward treatment of the average quantity of lignin in the product being treated. Prior systems for dealing with reject material in pulp producing assemblies utilizing oxygen delignification have dealt with refining the reject material and then returning it to the main pulp stream before the screening stage and/or directly before the oxygen delignification stage. However, even when this refined material is returned to the main pulp stream and again subjected to oxygen delignification, there is insufficient chemical allotted to the reject material because of its higher lignin content to effect complete delignification thereof, and thus significant quantities of "dirt" are still produced in the final pulp.

According to the present invention, the separated reject material is treated in such a way that the higher lignin content thereof is taken into account, and sufficient chemical is added directly to the reject material to insure proper treatment thereof so that when it is returned to the main pulp stream, it will not result in "dirt".

According to the method of the present invention, cellulosic fiber material is digested to produce pulp, the digested pulp is washed, oxygen delignification of the washed pulp is effected, and the reject material is separated at a separation stage from the pulp, the pulp in the main stream being passed to a further treatment station—which steps are conventional. According to the invention then further, the flow and consistency of the separated reject material is determined, the separated reject material is refined, and sufficient chemical is added to the separated reject material—based upon the flow and consistency thereof—so that subsequent delignification thereof may be effected. This subsequent delignification is effected in one of two ways. The first way is by the provision of a separate oxygen delignification stage in the reject line, and adding caustic and oxygen to a refiner associated with the reactor, the reactor effecting sufficient treatment of the material so that it may be returned to the main pulp stream, be washed, and result in pulp having a minimum amount of reject material. According to a second alternative of the present invention, sufficient caustic is added to the reject material to ultimately effect delignification thereof, the material is soaked in a soak tank for a predetermined period of time based upon the amount of caustic added and the initial flow and consistency measurements, and then the caustic soaked reject material is returned to the main pulp stream just before the oxygen delignification stage in the main pulp stream. Again, final pulp is produced having a minimum amount of reject material.

According to the apparatus of the present invention, a digester, washer, oxygen reactor, and screening assembly are provided in a main line, and in a reject line leading from the screening assembly means for determining the flow and consistency of the separated reject material are provided, means for refining the separated reject material, and means for adding sufficient chemical to the separated reject material, based upon the flow and consistency thereof, so that subsequent delignification thereof may be effected, the subsequent delignification being effected by a separate oxygen reactor in the reject line, or by a soak tank with subsequent return to the main line before the oxygen delignification stage.

It is the primary object of the present invention to provide a method and apparatus for producing pulp having a minimum amount of reject material therein. This and other objects of the invention will become clear from an inspection of the detailed description of the invention, and from the appended claims.

BRIEF DESCRIPTION OF THE DRAWINGS

FIGS. 1*a* through 1*c* illustrate exemplary prior art oxygen delignification systems for dealing with reject material;

FIGS. 2*a* and 2*b* are diagramatic showings of modifications of a first embodiment of an exemplary assembly according to the present invention; and FIGS. 3*a* and 3*b* are diagramatic views of modifications of a second embodiment of an assembly according to the present invention.

DETAILED DESCRIPTION OF THE DRAWINGS

Figure 2A:
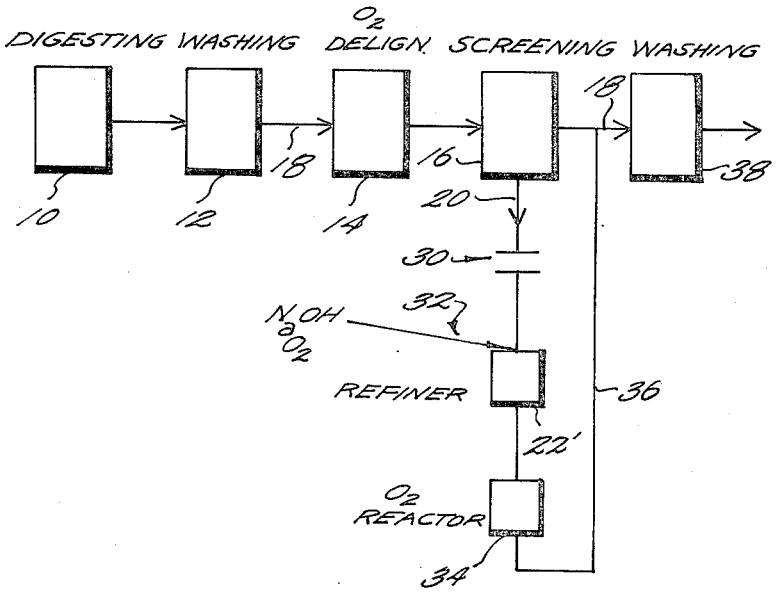

FIGS. 1*a* through 1*c* illustrate exemplary prior art proposals for dealing with reject material in oxygen delignification assemblies. Each system includes a digester 10, a washer 12 (which preferably is the lower portion of a conventional continuous digester such as a Kamyr digester with "Hi-Heat washing"), an oxygen delignification reactor 14, a screening assembly 16, the components 10, 12, 14, 16 being interconnected in a main line 18, a reject line 20 from the screening assembly 16, a refiner 22 in the reject line 20, and a line 26 for returning the refined reject material to the main line 18. In the prior art assembly of FIG. 1*a* (which is generally that proposed in U.S. Pat. No. 3,830,688 and "Oxygen-/Alkali Delignification at Kamyr Digester Blow Line Consistency—A Status Report", by P. J. Kleppe et al, Tappi, November, 1976) the reject material—after refining—is returned just prior to the screening assembly 16 and/or just prior to the oxygen delignification assembly 14. In the FIG. 1*b* proposal, a rescreening assembly 24 is inserted in the reject line 20, and the larger components separated by the rescreening assembly 24 are recirculated by line 28 back to the digester 10. In the FIG. 1*c* embodiment, screening takes place before oxygen delignification and the reject material—after refining—is returned to the main line 18 before the screening assembly 16. None of these prior art proposals take into account the higher lignin content of the reject material, rather attempting to effect subsequent delignification thereof—as originally—by treating the average lignin content of the pulp. Thus, a significant amount of "dirt" remains in the final pulp produced.

Exemplary assemblies according to the present invention are illustrated diagrammatically in FIGS. 2*a* and 2*b*, and 3*a* and 3*b*, of the drawings. The assemblies contain the conventional digester 10 and washer 12 (again, the digester 10 and washer 12 preferably being combined), an oxygen reactor 14, and a screening assembly 16. The oxygen reactor 14 preferably comprises a "Moss-type" reactor such as shown in U.S. Pat. No. 3,963,561, the disclosure of which is hereby incorporated by reference herein. Such a reactor effects more intimate mixing of the caustic and oxygen (and steam) added since a defibrator type mixer is provided right at the inlet of the reactor, and reaction takes place at digester consistency. The chemical has a tendency to stay much better with the material during treatment, resulting in a more even treatment of the product. The screening assembly 16 may be of any suitable conventional type such as shown in U.S. Pat. No. 4,000,063.

According to the embodiment of the invention illustrated in FIG. 2*a*, the reject line 20 is provided with means 30 for determining the flow and consistency of the separated reject material, means 22' for refining the separated reject material, and means 32 for adding sufficient chemical to the separated reject material based upon the flow and consistency thereof so that subsequent delignification thereof may be effected. Subsequent delignification is preferably effected by a separate oxygen reactor 34. The means 30 may comprise any flow and consistency measuring devices such as a magnetic flow measuring device, and consistency measuring devices such as shown in U.S. Pat. application Ser. No. 815,200, filed July 12, 1977 now U.S. Pat. No. 4,146,422. In the FIG. 2*a* embodiment, the reactor 34 also preferably comprises a Moss-type reactor, the refiner 22' being the defibrator leading into the reactor 34, and the caustic, oxygen (and steam) being added into the line 20 just before the refiner 22'. The flow and consistency of the material is directly proportional to the lignin content thereof (Kappa No.), and by utilizing conventional tables, or by utilizing computer control assemblies (such as shown in U.S. application Ser. No. 815,200 and the references cited therein.) The amount of chemical added at the chemical inlet line 32 is adjusted in dependence upon the Kappa No. of the reject material in line 20. After treatment in the oxygen reactor 34, the pulp is returned via the line 36 to the main pulp line 18. Preferably, a second washing stage 38 is provided after the screening assembly 16, and the line 36 feeds the pulp into the main line 18 just before the second washing station 38.

The only difference between the FIG. 2*b* modification and the FIG. 2*a* modification is that in the FIG. 2*b* modification screening is practiced before oxygen delignification rather than after it.

Figure 3A:
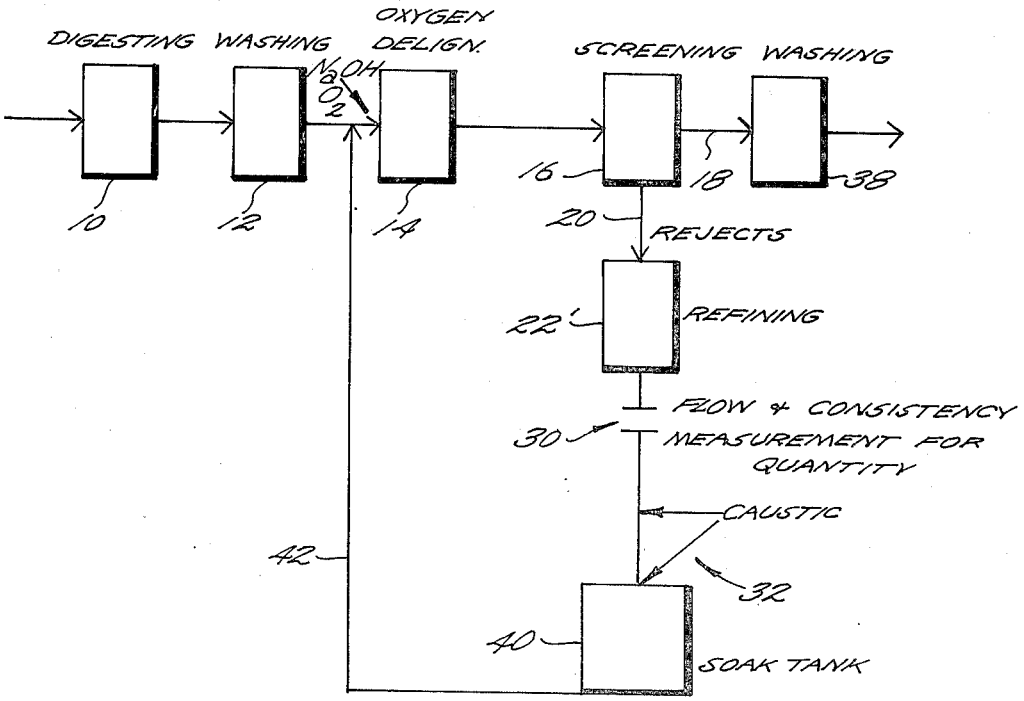

The purpose of the apparatus in FIG. 3*a* is to achieve the same substantial results as the FIG. 2*a* embodiment. In the FIG. 3*a* embodiment, refining takes place utilizing conventional refiner 22' before the flow and consistency measurement devices 30, and the chemical added to the reject material by means 32 is merely caustic (NaOH). A soak tank 40 is provided, the means 32 preferably metering the caustic into the soak tank 40, again, the amount of chemical (caustic) added being dependent upon the flow and consistency measurements (Kappa number) from means 30. After soaking in the soak tank 40, a predetermined period of time dependent upon the amount of caustic added and the initial flow and consistency measurements, the pulp is returned via line 42 to the main line 18 just before the oxygen reactor 14, the higher lignin content in the line 42 having sufficiently been treated by the caustic in the soak tank 40 so that by passing through the oxygen reactor 14, the same general degree of delignification thereof will be effected as for the rest of the pulp treated by the reactor 14. Thus, the amount of reject material in the final pulp produced is minimized.

The only difference between FIG. 3*b* modification, and the FIG. 3*a* modification, is that in the FIG. 3*b* modification, screening is practiced before oxygen delignification rather than after it.

According to the method of the present invention it will thus be seen that cellulosic fiber material is digested in digestor 10, washed in washer 12, oxygen delignification thereof is effected in reactor 14, and at separation stage 16, the reject material is separated in line 20 from the pulp in the main line 18, the main line 18 proceeding to a further treatment stage, such as a second washing stage 38, bleaching stage, or the like. The flow and consistency of the reject material in line 20 is determined by the means 30, the reject material is refined by the refiner 22', and sufficient chemical is added to the separated reject material, based upon the flow and consistency thereof (Kappa number) so that subsequent delignification thereof may be effected. Subsequent oxygen delignification thereof is effected in the FIGS. 2*a* and 2*b* embodiment by delignification in oxygen reactor 34, the chemical being added by the means 32 comprising caustic and oxygen (and steam) being added just before the refiner 22' of the Moss-type reactor 34. The delignified reject material is then returned to the main pulp line 18 via the line 36 just before the second washing stage 38 (just after the separation stage 16). In the FIGS. 3*a* and 3*b* embodiment, the chemical added is caustic, and the reject material is soaked in the soak tank 40 for a predetermined period of time dependent upon the amount of caustic added in the initial flow and consistency measurements (Kappa number), and then the caustic soaked reject material is returned to the main pulp line 18 just before the oxygen delignification stage 14.

It will thus be seen that according to the present invention, a method and apparatus have been provided which minimize the amount of reject material in the final pulp produced by taking into account the higher lignin content of normal reject material (e.g., knots) and gauging the chemical treatment to this higher content of lignin rather than gearing the chemical processes to the average amount of lignin in the material treated.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of delignification of cellulosic fiber material to minimize the amount of reject material in the final pulp produced, comprising the steps of:

(a) digesting cellulosic fiber material, to produce pulp;

(b) washing the digested pulp;

(c) effecting oxygen delignification of the washed pulp; and (d) separating at a separation stage reject material from the pulp, and passing the pulp in a main pulp stream, from which the reject material is separated, to a further treatment stage; wherein the improvement comprises:

(e) determining the flow and consistency of the separated reject material and refining the separated reject material; and (f) adding sufficient chemical to the separated reject material, based upon the flow and consistency thereof, so that subsequent delignification thereof may be effected.

2. A method as recited in claim 1 wherein chemical added to the reject material is caustic and oxygen and wherein subsequent delignification of the reject material is effected by delignification of the refined reject material in an oxygen reactor; and comprising the further step of returning the delignified reject material to the main pulp stream.

3. A method as recited in claim 1 wherein step (f) is practiced by adding caustic to the refined reject material, soaking the reject material in a soak tank for a predetermined period of time based upon the amount of caustic added and the initial flow and consistency measurements, and returning the caustic-soaked reject material to the main pulp stream just before oxygen delignification of the pulp in the main pulp stream.

4. A method as recited in claim 2 wherein step (e) is practiced by determining the flow and consistency of the separated reject material and then refining the reject material, and wherein the caustic and oxygen added to the reject material is added just prior to or during refining thereof.

5. A method as recited in claim 3 wherein the reject material is refined before the flow and consistency thereof is determined.

6. A method as recited in claim 3 wherein the caustic is added to the refined reject material by metering it into the soak tank.

7. A method as recited in claim 1 wherein said further treatment stage is a washing stage.

8. A method as recited in claim 1 wherein said separating step is practiced after oxygen delignification.

9. A method as recited in claim 1 wherein said separating step is practiced before oxygen delignification.

10. Apparatus for delignifying cellulosic fiber material to produce pulp substantially free of reject material, comprising a digestor; means for washing the digested pulp; means for effecting oxygen delignification of the washed pulp; means for separating reject material from the pulp; and a main line pulp conduit interconnecting said digestor washing means, oxygen delignification means, and separating means; wherein the improvement comprises means for determining the flow and consistency of the separated reject material; means for refining the separated reject material; and means for adding sufficient chemical to the separated reject material, based upon the flow and consistency thereof, so that subsequent delignification thereof may be effected.

11. Apparatus as recited in claim 10 wherein said oxygen delignification means comprises a first oxygen delignification means, and further comprising a second oxygen delignification means connected between said chemical addition means and said main line, after said means.

12. Apparatus as recited in claim 10 further comprising means for interconnecting the separated, dignified reject material to said main line just before said oxygen delignification means, and a soak tank connected between said chemical adding means and said main line.

13. Apparatus as recited in claim 10 further comprising a washer connected in said main line after said separating means and said oxygen delignification means.

14. Apparatus as recited in claim 10 wherein said separating means is disposed in said main line after said oxygen delignification means.

15. Apparatus as recited in claim 10 wherein said separating means is disposed in said main line between said oxygen delignification means and said means for washing the digested pulp.

* * * * *